United States Patent [19]

Fujikawa et al.

[11] Patent Number: 4,736,717

[45] Date of Patent: Apr. 12, 1988

[54] VALVE GEAR FOR FOUR-CYCLE ENGINE

[75] Inventors: Tetsuzo Fujikawa, Kobe; Toshiyuki Takada, Miki; Shinichi Tamba, Kakogawa, all of Japan

[73] Assignee: Kawasaki Jukogyo Kabushiki Kaisha, Japan

[21] Appl. No.: 848,206

[22] Filed: Apr. 4, 1986

[30] Foreign Application Priority Data

Apr. 4, 1985 [JP] Japan ..... 60-71716
Feb. 17, 1986 [JP] Japan ..... 61-32539

[51] Int. Cl.[4] ..... F01L 1/04
[52] U.S. Cl. ..... 123/90.2; 123/90.6
[58] Field of Search ..... 123/90.2, 90.21, 90.22, 123/90.23, 90.6

[56] References Cited

U.S. PATENT DOCUMENTS

| | | | |
|---|---|---|---|
| 386,213 | 7/1888 | Nash | 123/90.2 |
| 779,328 | 1/1905 | Svebilios | 123/90.2 |
| 1,248,597 | 12/1917 | Baker | 123/90.2 |
| 1,409,710 | 3/1922 | Haltenberger | 123/90.2 |

*Primary Examiner*—Ira S. Lazarus

[57] ABSTRACT

A valve gear for a four-cycle engine having an overhung crankshaft connecting with an output shaft, wherein a guide portion having such a shape folding the output shaft as to return back to a starting point in two turns, is formed on the output shaft, and an interlocking mechanism guided by the guide portion is provided to open the valves for the four-cycle engine. It is preferable that the guide portion is formed as cam face displacing the interlocking mechanism. The guide portion can be formed on a block other than the output shaft for easy machining and also for adjustable valve timing.

1 Claim, 5 Drawing Sheets

VALVE GEAR FOR FOUR-CYCLE ENGINE

FIELD OF THE INVENTION AND RELATED ART STATEMENT

This invention relates to a valve gear adapted for the general-purpose four-cycle engine of small size and simple construction having an overhung crankshaft to which an output shaft is connected.

Generally, the small general-purpose four-cycle engine requires low cost, light weight and compactness.

To meet aforesaid requirements, the prior art with relation to the overhung crankshaft has been known, wherein the cam shaft for driving the valves is disposed at right angles to the crankshaft to transmit the power from the crankshaft to the cam shaft through screw gearing.

This construction, however, requires not only the cam shaft but also the bearings for the cam shaft, which makes the engine large in size owing to a space for containing both of them.

Furthermore, the configuration results in high cost caused by the cam shaft and screw gearing, reduced reliability due to the wear of the screw gearing, and more complicated construction.

OBJECT AND SUMMARY OF THE INVENTION

It can be said that the purpose and object of this invention is to provide a valve gear adapted for the four-cycle engine low in cost, light in weight, compact and simple in construction, and high in reliability, eliminating aforesaid problems associated with the conventional valve gear using the screw gearing.

To achieve aforesaid object, a valve gear according to the invention adapted for the four-cycle engine having the overhung crankshaft connected to the output shaft, comprises a guide portion formed around the output shaft into such a shape as to return back to the starting point in turns, and an interlocking mechanism guided by the guide portion to open and close the valve system of the four-cycle engine.

It is advisable that aforesaid guide portion be formed into a cam face which displaces the interlocking mechanism as to open and close the valves.

Forming aforesaid guide portion between bearings disposed at two separate locations on the output shaft, prevents the rotation axis of the guide portion from being fluctuating due to the combustion force in the engine acting on the crankshaft.

Furthermore, aforesaid small guide portion is preferably prefabricated from a block other than the output shaft for accurate machining.

And, if aforesaid guide portion is prefabricated separately from the crankshaft and assembled thereon rotatably, and also a timing control mechanism to adjust the circumferential angle position of the guide portion on the crankshaft is provided for variable timing control, the timing control mechanism enables the valve timing to be matched for engine performance.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF THE PREFERRED EMBODIMENT

Figure 1:
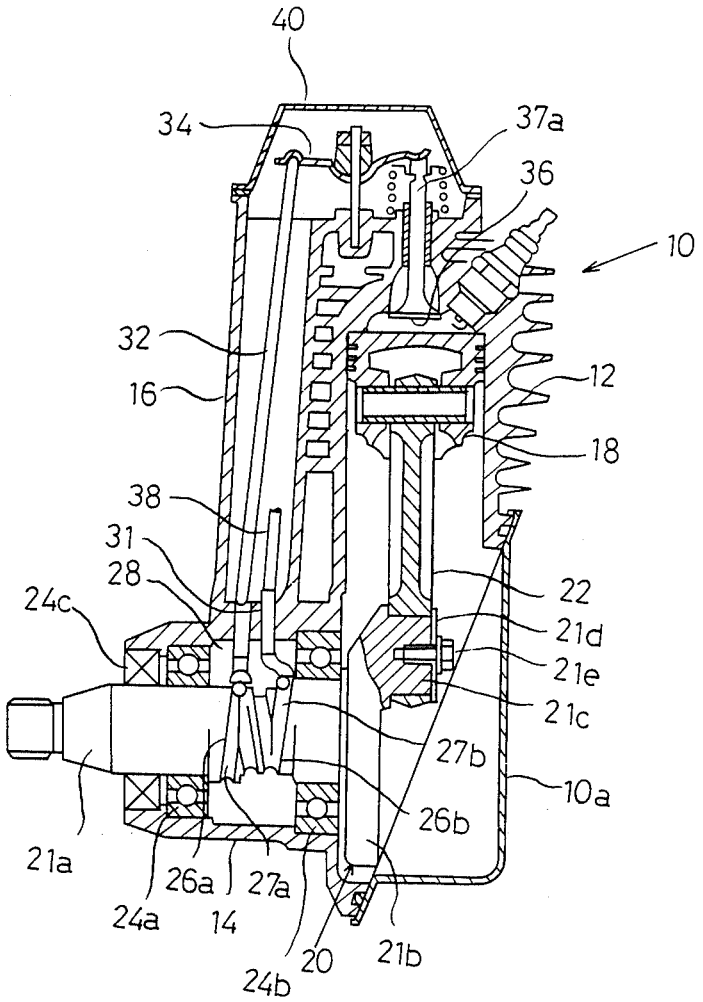
FIG. 1 is a vertical sectional view of a first embodiment for a four-cycle engine according to the invention.
Figure 3:
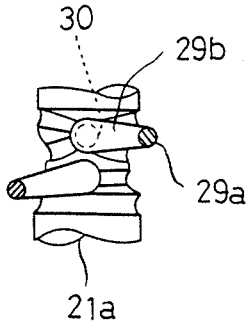
FIG. 3 is a sectional view taken along line III—III in FIG. 2.

FIG. 1 shows a small and versatile overhead valve type four-cycle engine according to the invention. In FIG. 1, Numeral 10 designates an engine block. A cylinder 12, a crankcase 14 and side cover 16 etc. are integrated into the engine block 10. The engine block 10 is opened cut obliquely at the right lower end portion thereof in the figure and enclosed by means of an oil pan 10*a*.

A piston 18 slidably fits into the cylinder 12, and a overhung crankshaft 20 is rotatably supported by the crankcase 14. And the piston 18 is connected to the overhung crankshaft 20 through a connecting rod 22.

The overhung crankshaft 20 is a one-piece forging consisting of an output shaft 21*a*, a crank web 21*b* and a crankpin 21*c*. A side plate 21*d* is mounted on the crankpin 21*c* by means of a bolt 21*e*. The output shaft 21*a* is supported to the crankcase 14 by two bearings 24*a* and 24*b* spaced by a fixed gap. The reason why the bearing 24*b* is larger in diameter than the other bearing 24*a* is to bear the combustion force acting on the overhung crankshaft 20, to readily load the bearings 24*a* and 24*b*, and to easily force-fit the output shaft 21*a*. Numeral 24*c* designates an oil seal.

On the output shaft 21a between the bearings 24*a* and 24*b*, a guide groove 26*a* (guide portion) for the intake valve is formed adjacent to a guide groove 26*b* (guide portion) for the exhaust valve.

The guide grooves 26*a* and 26*b* have such a shape as "figure-eight" when developed (See FIG. 4), folding around the output shaft 21*a* portion of the overhung crankshaft 20 while returning back to the starting point in two turns. The roots of the guide grooves 26*a* and 26*b* are formed as cam faces, and higher portions 27*a* and 27*b* (FIG. 1) are respectively formed at one location as to extend outwards in the radial direction of the output shaft 21*a*, and are circumferentially disposed so as to coincide with the crank angle respectively corresponding to each valve opening timing of the intake and exhaust valves.

Figure 2:
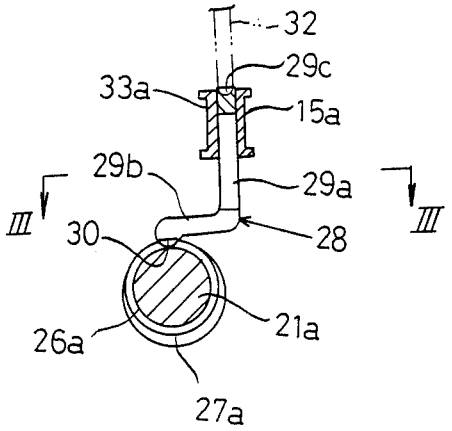
FIG. 2 is a vertical sectional view of a sliding piece in FIG. 1.

A sliding piece 28 (an interlocking mechanism) for the intake valve is engaged with the guide groove 26*a*, and at the upper end thereof is provided with a sliding shaft portion 29*a* formed into vertical slender rod shape as shown in FIG. 2. The sliding shaft 29*a* is rotatably and vertically slidably supported by a supporting wall 15*a* forming a part of the crankcase 14 in the engine block 10. At the lower end of the sliding piece 28, an arm 29*b* sideways extends essentially over the highest longitudinal line on the outer surface of the output shaft portion 21*a*, and can swing about the vertical axis of the sliding piece 28 as one-piece with the sliding piece 28.

A ball 30 is rotatably pivoted on the tip end of the arm 29*b* extending sideways to engage with the guide groove 26*a*.

The upper end portion of the sliding shaft 29 projecting upwards of the supporting wall 15*a* provides a bulbous seat 29*c* on which is rotatably pivoted a bulbous lower end portion 33*a* of a push rod 32 disposed in a push-rod insertion hole 16*a*.

The upper end portion of the push rod 32 extends upwards of the cylinder 12 to push up one end of a rocker arm 34 from below. The rocker arm 34 is rotatably supported on the upper portion of the cylinder 12, and the other end of the rocker arm 34 is depressed down against a valve rod 37*a* of an intake valve 36 to open it.

Another sliding piece 31 for the exhaust valve is similar to the above mentioned sliding piece 28 for the intake valve in construction. The higher portion 27*b* in the guide groove 26*b* on which the sliding piece 31 engages is disposed so as to coincide with the crank angle corresponding to the opening timing of aforesaid exhaust valve, i.e. so as to be located substantially 180 degrees apart from the other higher portion 27*a*.

At the upper portion of the sliding piece 31, another push rod 38 similar in construction to the push rod 32 is also supported to open the exhaust valve (not shown in the figure) in the same way as the intake valve 36. Numeral 40 in FIG. 1 designates a rocker cover.

Now, the following describes the operation. When the overhung crankshaft 20 turns, for example, the ball 30 for the intake valve 36, being guided by the guide groove 26*a*, comes in sliding contact with the full length of circumference of the guide groove 26*a*, while the overhung crankshaft 20 makes two turns. During the two turns, the intake valve 36 is once pushed down open by the higher portion 27*a*. On the other hand, the arm 29*b* extending sideways swings to the left and right on FIG. 1 respectively by one degree while the overhung crankshaft 20 makes two turns, and the sliding shaft 29*a* portion of the sliding piece 28 also rotates, but the pivot bearing of the lower bulbous end surface 33*a* of the push rod 32 against the mating bulbous seat 29*c* ensures a smooth lifting action of the push rod 32 by the sliding piece 28.

By the way, it is all the same with the push rod 38 for the exhaust valve.

Since the crank web 21*b* is required to contain only one overhung crankshaft 20, the crankshaft 14 of the engine block 10 is constructed in small size, and also can be cut obliquely at the right lower portion thereof to be covered with the oil pan 10*a*.

Because the crankcase 14 incorporates the output shaft portion 21*a*, supporting at two locations with the bearings 24*a* and 24*b*, it can provide the output shaft 21*a* of the overhung crankshaft 20 with a proper support without eccentricity, which would release larger vibrations than with the normal-type crankshaft. Therefore, if the guide grooves 26*a* and 26*b* be formed on the output shaft 21*a*, the rotation axis of them will not fluctuate, which ensures an accurate lifting of the intake valve 36 and the exhaust valve caused by the sliding piece 28 and 31 through the push rods 32 and 38.

Furthermore, a space, normally dead space in the prior art, surrounded with the side cover 16 over the crankcase 14, can be effectively utilized by disposing the push rods 32 and 38 therein, which results in making the engine compact as a whole.

Figure 5:
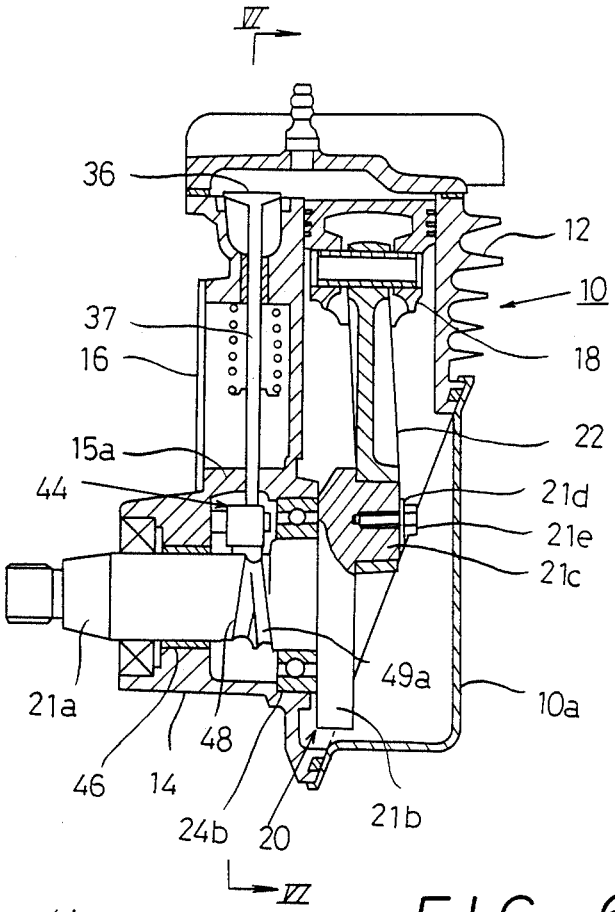
FIG. 5 is a vertical sectional view of another embodiment for the four-cycle engine according to the invention.

The following is the description of a second embodiment according to the invention, referring to FIG. 5, in which the like reference numerals are provided for the like or corresponding parts as those in aforesaid first embodiment in FIG. 1.

The second embodiment is adapted for a side valve type engine according to the invention, whose exhaust valve is not shown in the figure, but disposed behind and in juxtaposition to the intake valve 36 shown in FIG. 5, perpendicularly to the paper.

A valve stem 37*a* of the intake valve 36 extends downwards while penetrating slidably through a supporting wall 15*a*. The lower end thereof depresses down against one of bell cranks 50 which constitute an interlocking mechanism 44 detailed later. It is all the same with the exhaust valve. The interlocking mechanism 44 provides a pair of the bell cranks 50 disposed symmetrically to each other with respect to the axis of the output shaft 21*a* and guided by a guide groove 48 (guide portion) to open the intake valve 36 and the exhaust valve. The guide groove 48 is formed on the output shaft 21*a* between a metal bearing 46 and a bearing 24*b*.

Figure 6:
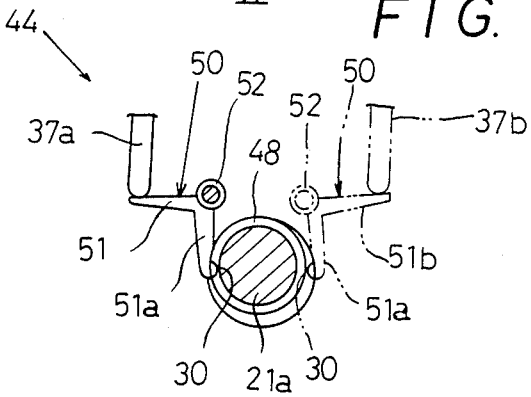
FIG. 6 is a partly sectional fragmentary illustration taken along line VI—VI in FIG. 5.

In this interlocking mechanism 44, as shown in FIG. 6, consisting of the bell cranks 50 and pivot shafts 52, the bell cranks 50 fit onto the pivot shafts 52 disposed parallel to the output shaft 21*a* and to each other, so that the bell cranks 50 respectively can move axially and rock about the axis of the pivot shaft 52. The tip ends of arms 51*a*, the lower portion of the bell cranks 50, respectively engage into the guide groove 48 through balls 30. And the tip ends of arms 51*b*, the sideways extending portion of the bell cranks 50, are respectively in contact with the lower end of the valve stems 37*a* and 37*b* from below.

Figure 4:
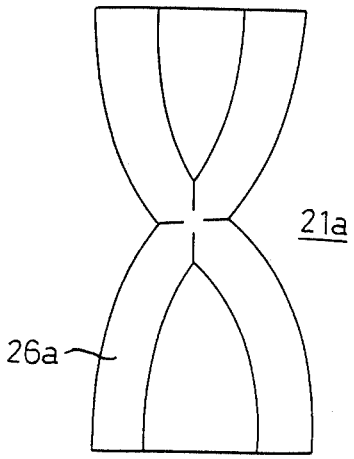
FIG. 4 is a segmentary side view of the guide portion.

The guide groove 48 has such a shape, folding around the output shaft 21*a*, as to return back to the starting point in two turns, similar to aforesaid guide groove in FIG. 4. And the root of the guide groove 48 is formed as cam face, and higher portions 49*a* (FIG. 5) are formed so as to come into contact with the respective bell cranks 50 at the crank angles corresponding to the intake and exhaust valve timings.

In the engine shown in FIG. 5, the respective bell cranks 50 rock about the pivot shafts 52 at the intake and exhaust valve timings by the cam action of the higher portions 49*a* so as to lift the intake and exhaust valve while the overhung crankshaft 20 makes two turns.

Figure 7:
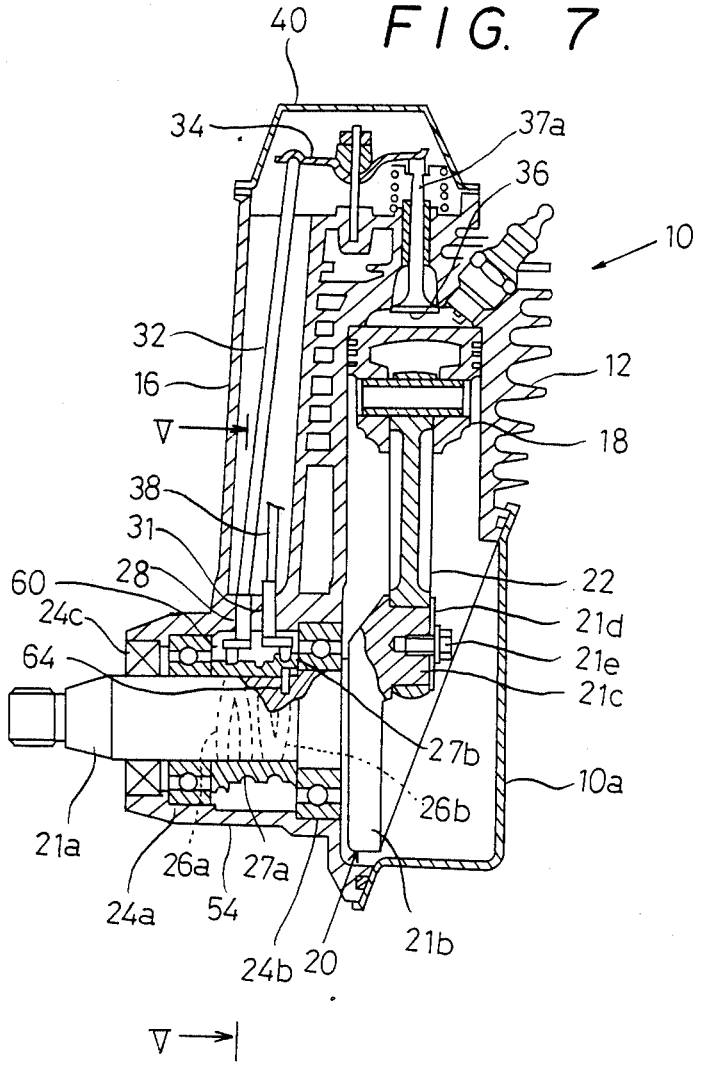
FIG. 7 is a vertical sectional view of a third embodiment for the engine.

The following is the description of a third embodiment according to the invention, referring to FIG. 7. In this embodiment, guide grooves 26*a* and 26*b* for driving the valves are not directly formed on the outer surface of an output shaft 21*a*, but on the outer surface of a collar 60 prefabricated on a block other than the output shaft 21*a* to fit thereto. Except for the above, the construction is similar to that of the first embodiment shown in FIG. 1, so the like reference numerals are provided for the like parts as those in the first embodiment.

An inner surface 62 of the collar 60, substantially cylindrical, is in close contact with the outer surface of the output shaft 21*a*, and the collar 60 is secured in place on the output shaft 21*a* with pins 64.

Because, in the valve gear of this embodiment, as mentioned above, the guide grooves are formed on the collar 60 other than the crankshaft 20, the collar 60 alone can be precisely machined to form the guide grooves 26*a* and 26*b* on the outer surface thereof in the manufacture and assembly of the engine. In the machining operation of the guide grooves 26*a* and 26*b* having such a complex shape, the collar 60 can be easily set on the machine in any position or easily handled by the operator for machining, because the collar 60 is very small in size compared with the crankshaft 20.

To harden the guide grooves 26*a* and 26*b* prone to wear due to balls 30 pivoting thereto, only the collar 60 made separately from the crankshaft 20 is hardened and heat treated. Such being the case, the guide grooves 26*a* and 26*b* can be hardened, which results in reducing the wear of the guide grooves 26*a* and 26*b*, while the conventional guide grooves formed integrally with the crankshaft 20 has been difficult to be hardened.

In addition, if the guide grooves 26*a* and 26*b* get worn out after a long period of use, only the collar 60 ought to be taken out from the crankshaft 20 to replace with a new collar 60.

Adjusting the valve timing can be easily carried out only by changing the circumferential angle of the collar 66 to be placed and securing with the pins 64.

Figure 8:
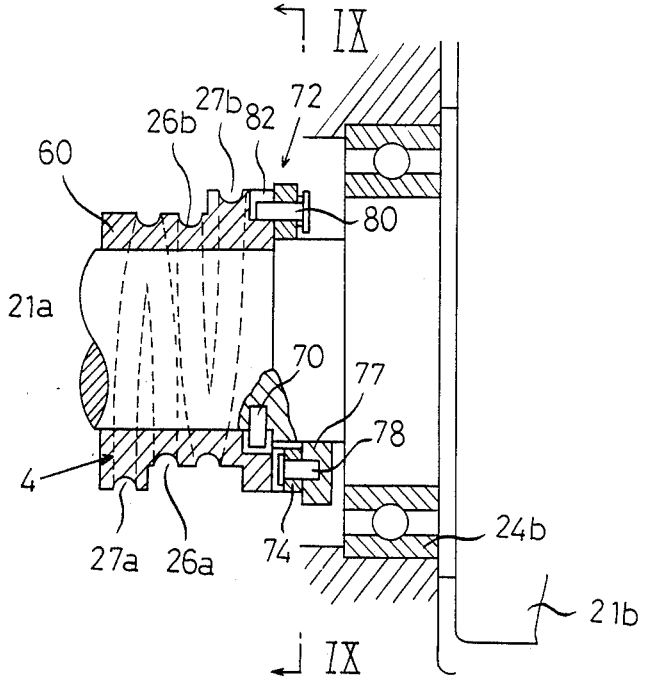
FIG. 8 is a vertical sectional view of the major parts of an engine according to a fourth embodiment.
Figure 9:
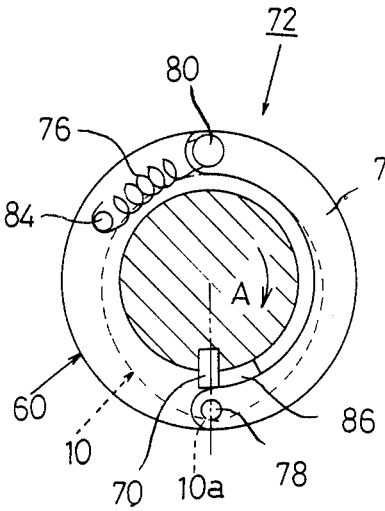
FIG. 9 is a sectional view taken along line IX—IX in FIG. 8.
Figure 10:
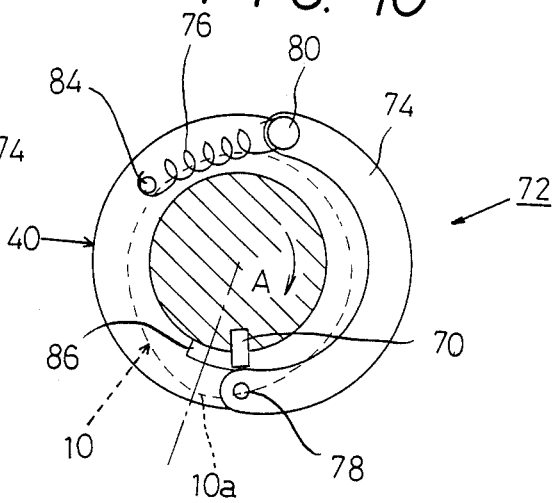
FIG. 10 is a schematic illustration showing the construction of the centrifugal governor operating at high speed.

The following is the description of a fourth embodiment according to the invention, referring to FIG. 8 through FIG. 10. In the embodiment, the valve timing is made variable according to the running performance of the engine, by providing guide grooves 26*a* and 26*b* of the valve gear on a collar 60 made separately from an output shaft 21*a* so as to vary the timing angle of the output shaft 21*a*.

In FIG. 8 showing the major parts of the fourth embodiment, the like reference numerals are provided for the like or corresponding parts as those in aforesaid embodiment in FIG. 7.

The collar 60 is secured circumferentially to the output shaft 21*a* with set pins 70 so as to rotatably displace within a fixed degree as detailed later. A small space is provided between the right end surface of the collar 60 and the left end surface of a bearing 24*b*, in the figure, and a centrifugal governor 72 (timing adjusting mechanism) is provided therein for changing the valve timing.

As shown in FIG. 9, the centrifugal governor 72 consists of a governor weight 74, a coiled tension spring 76, a set pin 78 and an engaging pin 80. The governor weight 74 has such a shape as an arc extending over substantially half of the circumference of the collar 60, and set to a given mass. The lower end portion of the governor weight 74, in the figure, is rotatably fixed with the set pin 78 to a member 77 secured onto the surface of the output shaft 21*a* near the bearing 24*b*.

On the other hand, on the upper end portion of the governor weight 74, the engaging pin 80 is provided to engage with a cutout portion 82 (FIG. 8) in the collar 60, and also is engaged with the right end portion, in FIG. 9, of the coiled tension spring 76. The left end portion of the coiled tension spring 76 is fixed to the left end surface of the collar 60 (in FIG. 8) with a pin 84.

An arc-shaped groove 86 is formed on the inner surface of the collar 60 at the left end portion, and the collar 60 is rotatably held circumferentially onto the output shaft 21*a* within the arc-shaped groove 86 with aforesaid pin 70 engaging the arc-shaped groove 86.

From now, the operation of the fourth embodiment is described. When the engine starts running, the rotation of the output shaft 21*a* in the direction of Arrow A in FIGS. 9 and 10 produces a centrifugal force acting on the governor weight 74. At low speed with small centrifugal force, the governor weight 74 is being pulled to the left in FIG. 9 checked by the coiled tension spring 76, and the collar 60 connecting to the engaging pin 80 at the cutout portion 82 is poised at zero degree in advance angle when the higher portions 27*a* and 27*b* on the guide grooves 26*a* and 26*b* (cam face) line up almost vertically. Then, such valve timing as brought about can be desirable for low engine speed.

In time, as the engine speed comes up, as shown in FIG. 10, a large centrifugal force due to higher engine speed, acting on the governor weight 74 causes the upper end portion of the governor weight 74 to rotate about the set pin 78 in the right direction of the figure against the force of the coiled tension spring 76, thus causing the collar 60 connecting with the engaging pin 80 in the cutout portion 82 to rotation the direction of Arrow A. As the result, the higher portions 27*a* and 27*b* on the guide grooves 26*a* and 26*b* move within the arc-shaped groove 86, thus increasing the amount of advance angle by this amount of movement. Then, the valve timing will change into optimum setting for high engine speed.

As mentioned above, the invention can provide for:

a remarkable reduction in cost, and a compact size of engine, because of the elimination of the cam shaft;

elimination of the need for machining the speed-reduction gears and sprockets in use for the cam shaft, thus minimizing the time required for machining; and a reduction of noise when the engine is running.

In addition, this invention is not limited to the above embodiments, but optimal combinations of the valve position and the interlocking mechanism can be selected at will.

The guide means is not limited to the guide grooves in the above embodiments, but the guide rails of metal bar can be alternatively employed.

It will be obvious to those skilled in the art that various changes may be made in the invention without departing from the spirit and scope thereof and therefore the invention is not limited by that which is shown in the drawings and described in the specifications but only as indicated in the appended claims.

What is claimed is:

1. A valve gear adapted for use in a four-cycle engine comprising:

a crankcase;

a one-piece output shaft disposed within said crankcase;

a crankcase connected to said output shaft by a crankweb;

a first bearing supporting said output shaft at a first journal portion of said output shaft on said crankcase;

a second bearing supporting said output shaft at a second journal portion of said output shaft on said crankcase, said second bearing being spaced from said first bearing along the longitudinal axis of said output shaft to define a gap between said bearings and being larger than said first bearing, said second bearing being located adjacent to said crankweb;

two two-revolution guide grooves defined in said output shaft to be located within said gap, said guide grooves having roots forming cam faces and high portions;

the outer diameter of said second journal portion of said output shaft being larger than that of said output shaft portion on which said two two-revolution guide grooves are formed, and the outer diameter of said first journal portion of said output shaft being smaller than the latter; and interlocking means movably engaged with said guide grooves and connected to valves associated with the engine to operate those valves according to the location of said interlocking means in said guide grooves.

* * * * *

UNITED STATES PATENT AND TRADEMARK OFFICE

CERTIFICATE OF CORRECTION

PATENT NO. : 4,736,717

DATED : April 12, 1988

INVENTOR(S) : Tetsuzo Fujikawa, Toshiyuki Takada, Shinichi Tamba

It is certified that error appears in the above-identified patent and that said Letters Patent is hereby corrected as shown below:

column 6, line 57, "crankcase" should read -- crankshaft --

Signed and Sealed this

Twelfth Day of September, 1989

*Attest:*

DONALD J. QUIGG

*Attesting Officer*

*Commissioner of Patents and Trademarks*